US009555552B2

(12) United States Patent
Skinner et al.

(10) Patent No.: US 9,555,552 B2
(45) Date of Patent: Jan. 31, 2017

(54) TRIMMER LINE CUTTING DEVICE AND METHOD

(75) Inventors: David B. Skinner, Columbia, SC (US); Mark Wilkinson, Irmo, SC (US)

(73) Assignee: Shakespeare Company, LLC, Columbia, SC (US)

( * ) Notice: Subject to any disclaimer, the term of this patent is extended or adjusted under 35 U.S.C. 154(b) by 829 days.

(21) Appl. No.: 13/478,606

(22) Filed: May 23, 2012

(65) Prior Publication Data

US 2012/0297626 A1 Nov. 29, 2012

Related U.S. Application Data

(60) Provisional application No. 61/489,730, filed on May 25, 2011.

(51) Int. Cl.
*B26D 3/16* (2006.01)
*B26D 7/01* (2006.01)

(52) U.S. Cl.
CPC .. *B26D 3/16* (2013.01); *B26D 7/01* (2013.01)

(58) Field of Classification Search
CPC ..... B26D 3/16; B26D 7/01; Y10T 83/8821; Y10T 83/0419
USPC ..... 30/92, 194, 225, 241, 272.1, 275.4, 278,30/280, 282, 286, 289, 291, 294, 314, 315
See application file for complete search history.

(56) References Cited

U.S. PATENT DOCUMENTS

| | | | | |
|---|---|---|---|---|
| 3,372,477 | A * | 3/1968 | Hoppe | 606/138 |
| 4,051,756 | A | 10/1977 | Bognar et al. | |
| 5,070,616 | A * | 12/1991 | Chen | 30/92 |
| 5,203,083 | A | 4/1993 | Domonoske | |
| 5,556,407 | A * | 9/1996 | Wurster et al. | 606/174 |
| 5,890,291 | A | 4/1999 | Crum | |
| 5,946,997 | A | 9/1999 | Nicholson, Jr. | |
| 6,254,620 | B1 * | 7/2001 | Koh et al. | 606/167 |
| 7,305,910 | B1 | 12/2007 | Bermes | |
| 7,908,953 | B2 | 3/2011 | Yarborough et al. | |
| 2001/0015119 | A1 * | 8/2001 | Carter | 83/54 |
| 2004/0093736 | A1 | 5/2004 | Kuo | |
| 2011/0313430 | A1 | 12/2011 | Miller | |

* cited by examiner

*Primary Examiner* — Phong Nguyen

(57) ABSTRACT

A cutting device includes a body and a cutting blade assembly. The cutting blade assembly includes a cutting blade having a cutting edge and is reciprocally secured to the body. Movement of the cutting blade assembly from a retracted position to an engaged position causes the cutting edge to engage a line, such as a monofilament trimmer line, to cut the line to a desired length. Tension may be created in the line prior to cutting by positioning the line in a non-linear trough in the body.

3 Claims, 18 Drawing Sheets

TRIMMER LINE CUTTING DEVICE AND METHOD

CROSS REFERENCE TO RELATED APPLICATIONS

This application claims the benefit of U.S. Provisional Patent Application No. 61/489,730, filed May 25, 2011, the disclosure of which is incorporated herein by reference.

FIELD OF THE INVENTION

This invention relates generally to a cutting device for monofilament lines. More particularly, this invention relates to a cutting device for monofilament lines that is intuitive and easy to use, and is suited for positioning on a package of the monofilament line.

BACKGROUND OF THE INVENTION

Monofilament lines are well known in the art and include strings made from a single fiber. Exemplary monofilament lines include vegetation trimmer or cutting lines, pulling lines, fishing lines and utility lines. The monofilament lines may be made from single component filaments or from multi-component filaments, and may be produced by a variety of methods such as, for example, molding, extruding and/or spinning. Many monofilament lines are made from polymeric materials. Typically, monofilament lines are produced and packaged in bulk form. Thus, a continuous line of single or multi-component filament is wound or otherwise positioned into a container or package designed to hold the monofilament line. Therefore, cutting the line is the responsibility of the user when it is necessary to cut the line to length for the intended use.

Packaging of the monofilament lines may be provided in a wide variety of forms, but typically involves winding the line onto a spool or within a container. The spool or container may be adapted to maintain the line in an organized, wound configuration and to allow for easy removal of a portion of the line from the package. A common type of container used in packaging monofilament lines is known as a "donut package" due to the shape of the wound monofilament line within the package. The package and the line packaged within it may be in the form of a donut.

Conventional string trimmers or weed cutting apparatuses utilized a portion of a monofilament line wound around a spool in the head of the trimmer. This length is typically 15 to 50 feet. However, string trimmers and weed cutting devices have increasingly employed fixed line heads in which a relatively short length of line, typically between 6 to 18 inches, are inserted into the heads of the trimmers. In response, manufacturers of monofilament trimmer line have begun producing some trimmer line prepackaged in relatively short lengths suitable for use in newer string trimmers and weed cutting devices. Production of monofilament line in these short lengths increases both the cost and complexity of the manufacturing process, which results in higher costs to consumers. However, where monofilament trimmer line is provided in longer lengths, a user must use an auxiliary cutting device to create the necessary shorter lengths for use in some newer string trimmers. This reliance on auxiliary cutting devices is also not ideal as many common cutting devices (e.g., scissors, utility blades) are not particularly suited for cutting monofilament lines, especially those having larger diameters.

U.S. Pat. No. 7,908,953 discloses a cutting tool attached to a package for wound line. The package and cutting tool are intended to alleviate the need for prepackaged monofilament line of relatively short lengths as well as reliance upon auxiliary cutting devices not particularly suited for cutting the trimmer line. However, the disclosed cutting tool suffers from its own disadvantages. The actuating mechanism of the cutting tool results in a downward force acting on the trimmer line packaging. This downward force is likely to cause damage to the packaging containing the remaining trimmer line. In addition, the plastics used to form conventional packaging do not always provide a stable surface for application of the force necessary to cut the line, depending on the thickness of the plastic.

Thus, there is a need for an improved cutting device for monofilament trimmer line that alleviates one or more of the deficiencies of the prior art.

SUMMARY OF THE INVENTION

In general, a cutting device for a flexible line according to the present disclosure includes a body including a non-linear trough with an open top; and a blade assembly slidably carried by the body, the blade assembly including a cutting blade having a cutting edge, the blade assembly movable between a retracted position where the cutting blade is not positioned in the trough, and an engaged position where the cutting blade is positioned in the trough, the cutting edge adapted to engage and cut a line extending through the trough as the blade assembly moves from the retracted position to the engaged position.

In accordance with at least one aspect of the present invention, a cutting device includes a body including a post having a radiused surface and a recess in the radiused surface; and a reciprocating cutting blade assembly including a cutting blade with a cutting edge movable between a retracted position where the cutting edge is spaced from the recess and an engages position where the cutting edge is positioned within the recess in the post, the cutting blade assembly adapted to cut a line wrapped around the post and extending over the recess as it moves linearly from the retracted position to the engaged position.

In accordance with at least one aspect of the present invention, a method of cutting a line includes the steps of positioning the line in a non-linear trough formed in a body of a cutting device to create a stressed surface of the line and a compressed surface of the line; and sliding a cutting blade assembly into the non-linear trough to cause a cutting edge of a cutting blade and engage the stressed surface of the line.

BRIEF DESCRIPTION OF THE DRAWINGS

For a full understanding of the invention reference should be made to the following detailed description and the accompanying drawings, wherein.

DETAILED DESCRIPTION OF THE ILLUSTRATIVE EMBODIMENTS

Figure 1:
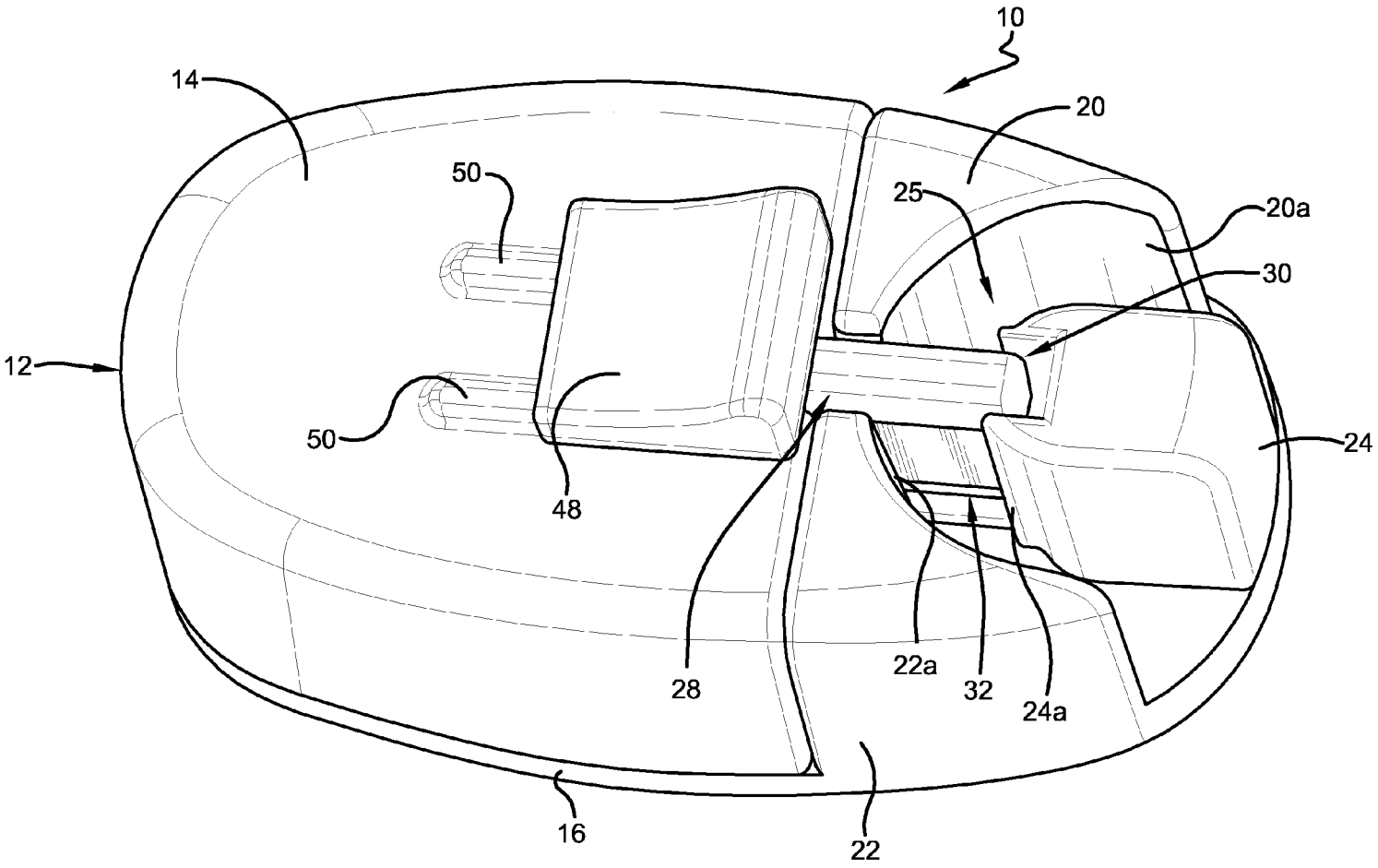
FIG. 1 is a top perspective view of a line cutting device according to the concepts of the present disclosure.
Figure 2:
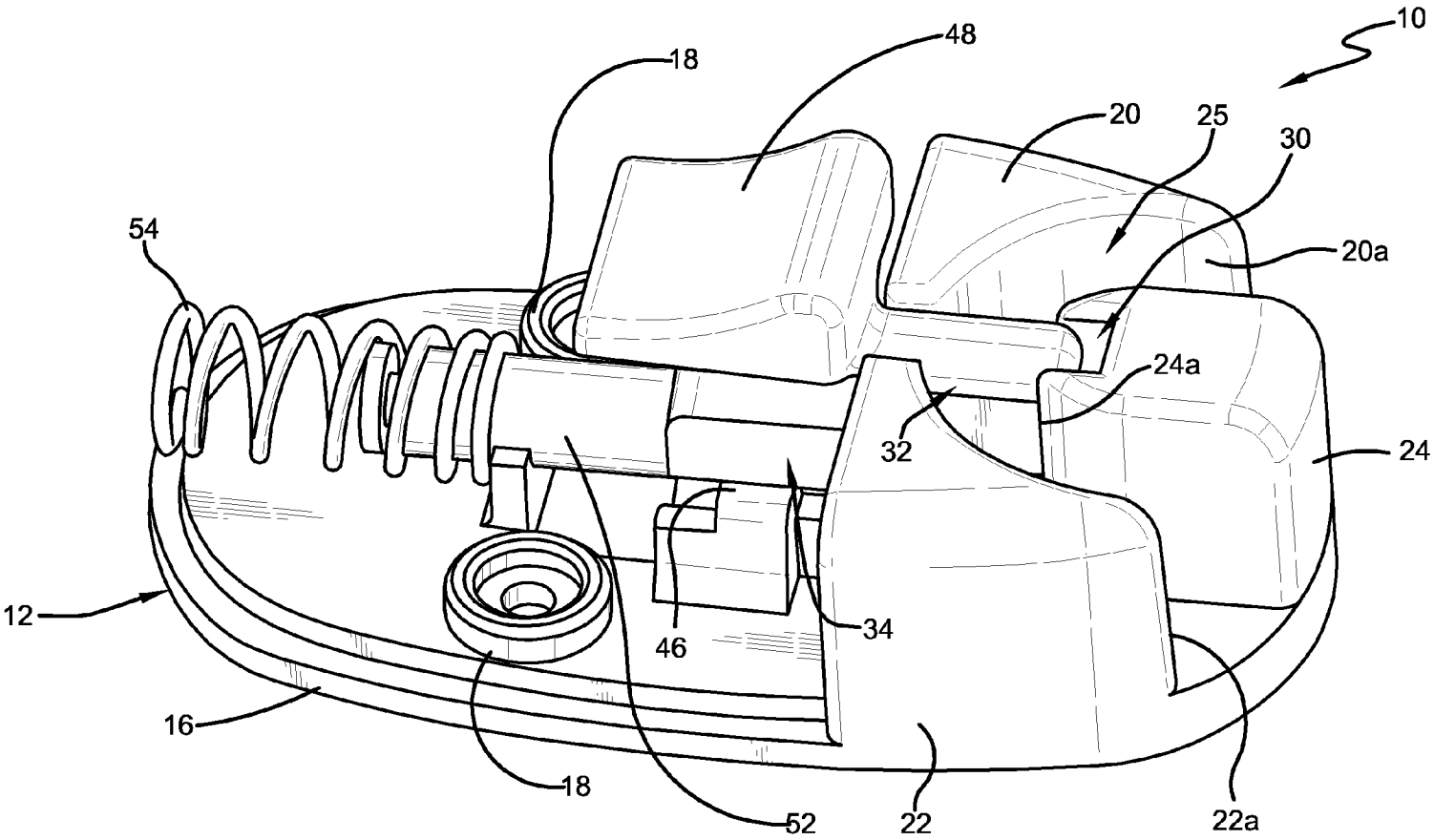
FIG. 2 is a top perspective view of the line cutting device of FIG. 1 with the cover portion removed to show the blade assembly.

Referring now to FIGS. 1-5, a cutting device is shown and is generally indicated by the numeral 10. The cutting device 10 is adapted to cut a monofilament line to a desire length. For example, the cutting device 10 may be used to cut a spool of trimmer line to a length suitable for use with a grass and weed trimmer. As will be appreciated by those skilled in the art, such monofilament lines are often flexible and designed to resist chipping and cracking, and may be resistant to cutting.

In one or more embodiments, cutting device 10 may include a body 12 formed from a cover portion 14 secured to a base portion 16. The body 12 may be formed from any suitable materials known to those skilled in the art. In certain embodiments, the body 12 may be formed from one or more polymeric materials. In certain embodiments, cover portion 14 may be secured to the base portion 16 by one or more screws (now shown) that pass through wells 18 in the base portion 16 and are received in threaded bores formed in the cover portion 14. Alternatively, the cover portion 14 may be secured to the base portion 16 by other suitable mechanisms known to those skilled in the art, such as, for example, glue, RF welding or ultrasonic welding.

The base portion 16 includes a first projection 20, a second projection 22, and a post 24 that together define an arcuate trough 25 in the body 12. In one or more embodiments, the trough 25 may be generally U-shaped. First and second projections 20, 22 each include a radiused surface 20*a*, 22*a*, respectively, that combine to form an outer surface of the arcuate trough 25. The post 24 includes a radiused surface 24*a* facing the radiused surfaces 20*a* and 22*a* of the first and second projections 20 and 22 to form an inner surface of the arcuate trough 25. A gap 28 between the first and second projections 20, 22 is adapted to receive a reciprocating blade, as will be discussed in greater detail below.

In one or more embodiments, the size of the trough 25 may be sufficiently small to prevent insertion of a finger or other body parts therein. As will be apparent to those skilled in the art, this reduces the risk of injury to a user because the blade of the cutting device is only capable of engaging objects positioned within the trough. For example, in certain embodiments, the trough may have a width between the radiused surface 24*a* and the radiused surfaces 20*a* and 20*b* of less than 0.5 inches, in other embodiments less than 0.4 inches, and in yet other embodiments less than 0.3 inches.

In certain embodiments, the post 24 includes a recess 30 facing and aligned with the gap 28. Recess 30 may be adapted to receive a portion of a blade assembly 32 therein. The blade assembly extends through the gap 28 and may be moved between a retracted position where it is spaced from the post 24 and an extended position where it is engaged with the post 24 at the recess 30.

Figure 3:
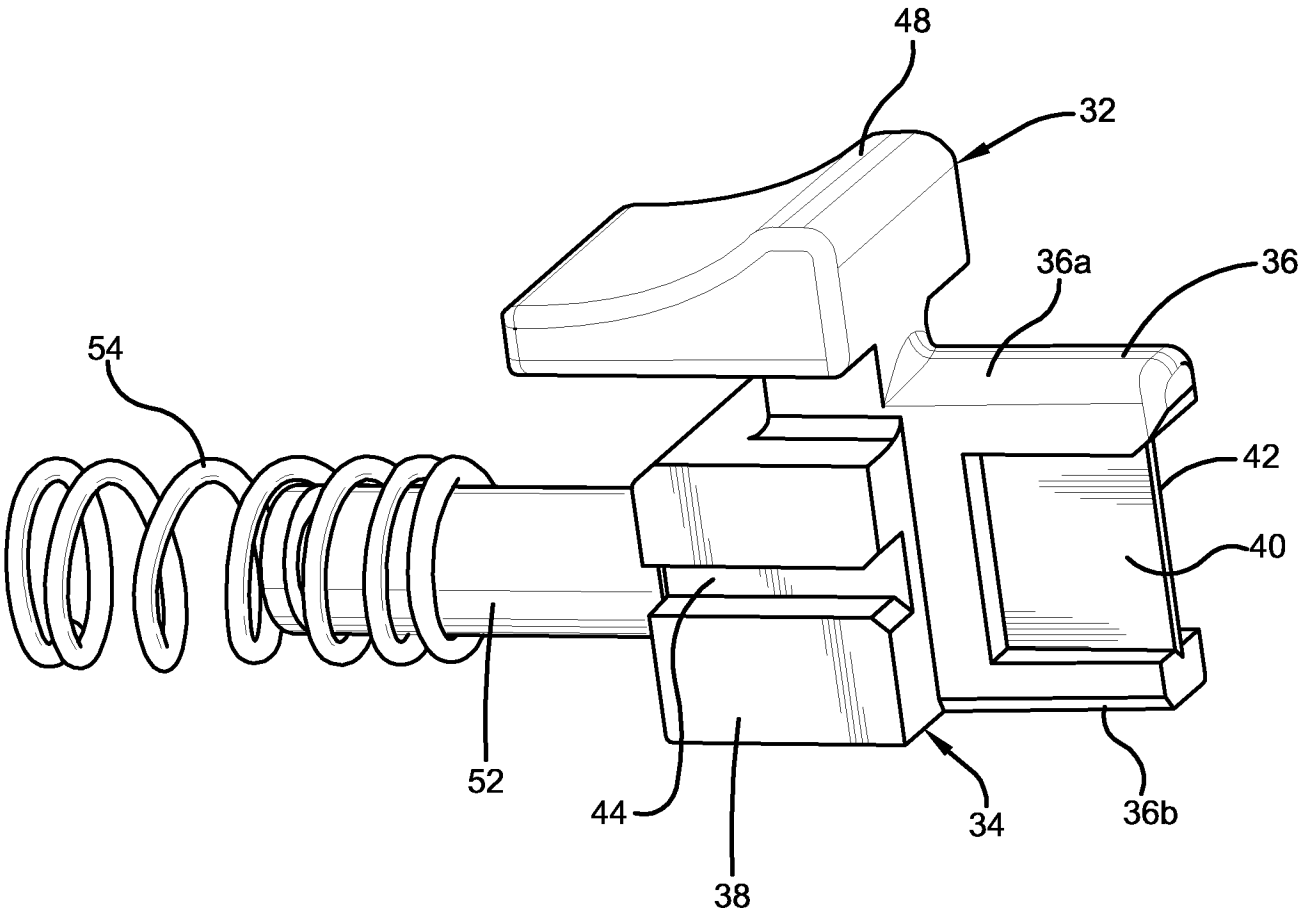
FIG. 3 is perspective view of the blade assembly according to the concepts of the present disclosure.
Figure 4:
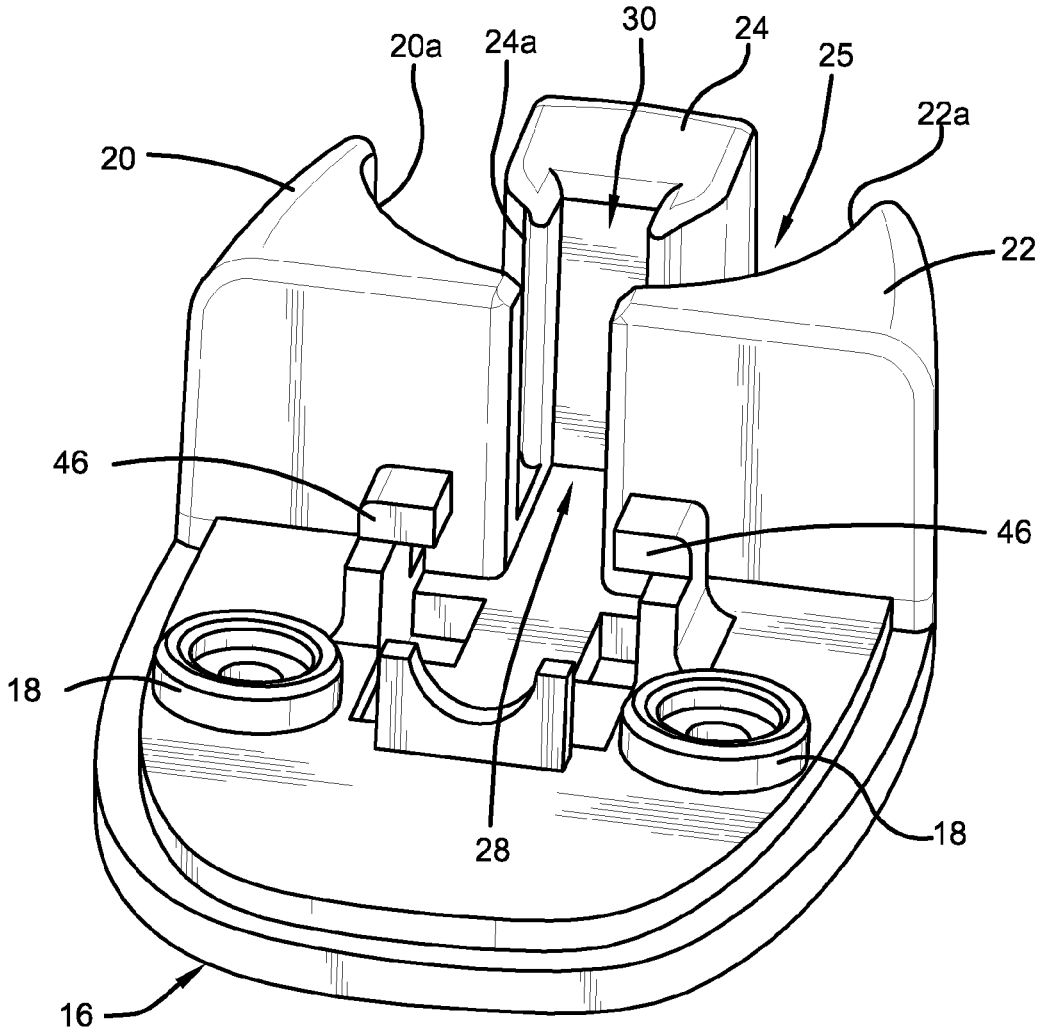
FIG. 4 is a rear perspective view of a base portion of the cutting device of FIG. 1.
Figure 5:
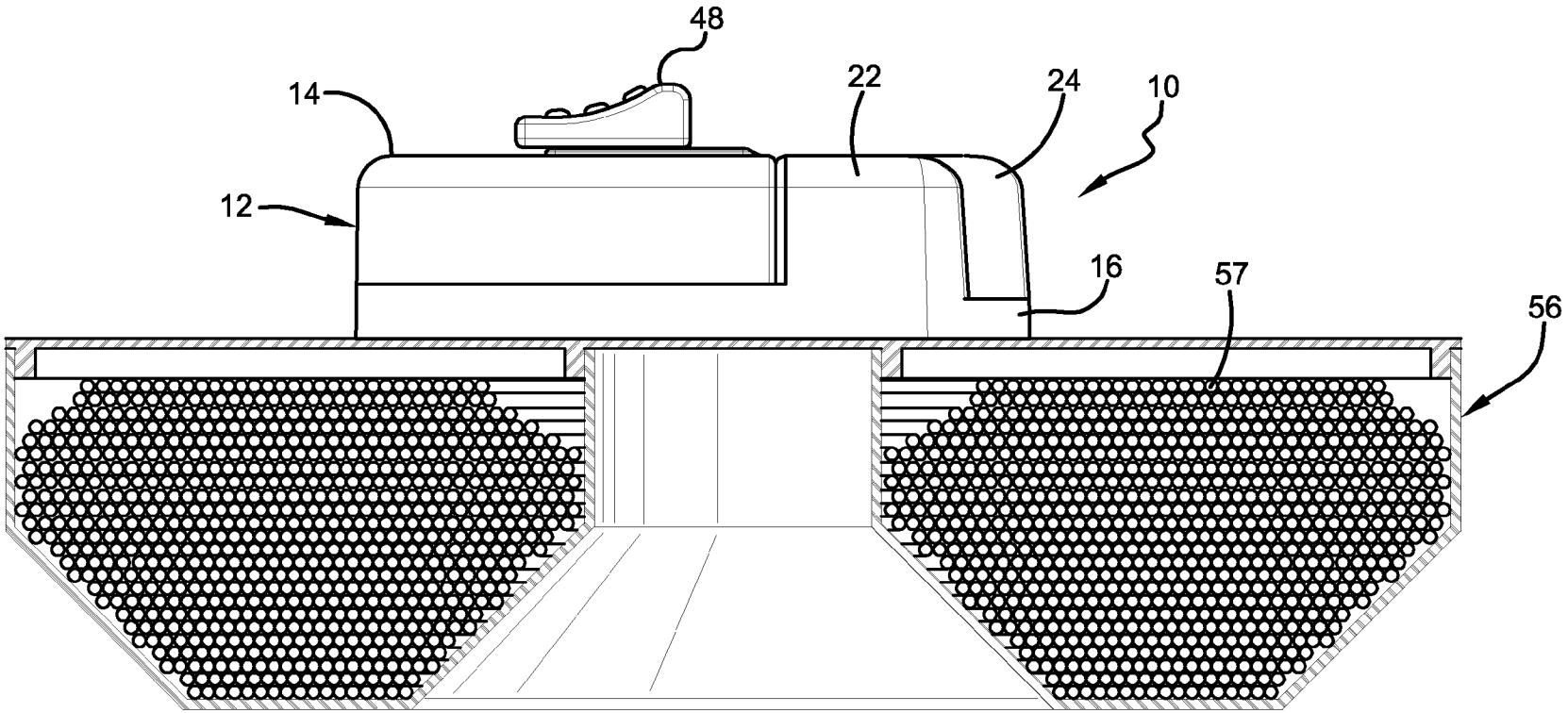
FIG. 5 is a partial section view of a trimmer line package including the line cutting device of FIG. 1 according to the concepts of the present disclosure.

In one or more embodiments, and as best shown in FIG. 3, the blade assembly 32 may include a body 34 having a blade portion 36 and a support portion 38. The blade portion 36 extends from the support portion 38 and partially encloses a blade 40 therein. A cutting edge 42 of the blade 40 is exposed and faces away from the support portion 38. In certain embodiments, the blade 40 may be pressed into a slot in the blade portion 36 of the body 34 toward the support portion 38. The resistance to cutting prevents the blade 40 from being removed. In certain embodiments, arms 36*a* and 36*b* of the blade portion 36 are positioned over the top and bottom edges of the cutting blade 40.

In certain embodiments, the support portion 38 may include slots 44 on opposing sides, the slots adapted to receive rails 46 (FIG. 4) carried by the base portion 16. The slots 44 and rails 46 slidably secure the blade assembly 32 within the body 12 and allow reciprocation between the retracted and extended positions. A button 48 may extend upwardly from the support portion 38 for user engagement. One or more openings 50 in the cover portion 14 of the body 12 may allow for reciprocating movement of the button 48, which extends through the opening 50.

The blade assembly may also include a rod 52 extending from the support portion 38 in a direction opposite and generally parallel to the blade portion 36. A spring 54 may be positioned around the rod 52 to bias the blade assembly 32 toward the post 24 and recess 30. Thus, absent a force exerted by a user with the button 48 to overcome the biasing force of the spring the cutting edge 42 of the blade 40 is positioned within the recess 30.

In use, a length of monofilament line is positioned within the trough 25. Three points of contact are created between the flexible line and the body 12 of the cutting device a first point at the radiused surface 24*a* of the post 24, a second point at the distal end of the radiused surface 20*a* of the first projection 20, and a third point at the distal end of the radiused surface 22*a* of the second projection 22. The arcuate nature of the trough 25 causes compression of the line adjacent to the post 24, and stressing of the line adjacent the first and second projections.

As will be understood by those skilled in the art, the blade assembly 32 is moved to a retracted position to allow positioning of the monofilament line in the trough 25. The line may be retained within the trough 25 by the friction between the line and the radiused surfaces of the trough 25, thereby allowing a user greater freedom to use both hands after positioning the line. Once the line has been positioned in the trough 25, the button 48 may be released, allowing the blade assembly 32 to move toward the engagement position by virtue of the biasing force exerted on the assembly by the spring 54. Upon movement of the blade assembly 32 toward the post 24, the cutting edge 42 of the blade 40 contacts the line adjacent the recess 30. In certain embodiments, the biasing force provided by the spring 54 may be sufficient to cut the tensioned line. In other embodiments, a user may apply additional cutting force through button 48, as necessary.

In one or more embodiments, the cutting device 10 may be provided as a part of a trimmer line package 56 having a length of trimmer line 57 disposed therein. As will be understood by those skilled in the art, the trimmer line 57 be a continuous length of monofilament line and may be coiled within the package 56. In certain embodiments, the cutting device 10 may be provided on or form a top surface of the package 56. The trimmer line disposed within the packaging 56 may be withdrawn and positioned within the trough 25 to cut a desired strip of the line for use. Notably, the cutting forces exerted by the cutting device 10 would not compress the packaging 56 because no downward forces are required to generate movement of the cutting blade assembly 32. Thus, the package is maintained in its original form regardless of the activity of cutting blade assembly.

The cutting device 10 is intuitive to use due to the shape and configuration of the trough 25 and blade assembly 32. In addition, the tension created in the line by virtue of the non-linear trough 25 reduces the force required to cut the line. Furthermore, the cutting blade 40 is protected by the blade portion 36, and the recess 30, thereby making the cutting device safer to use than conventional cutting devices.

Figure 6:
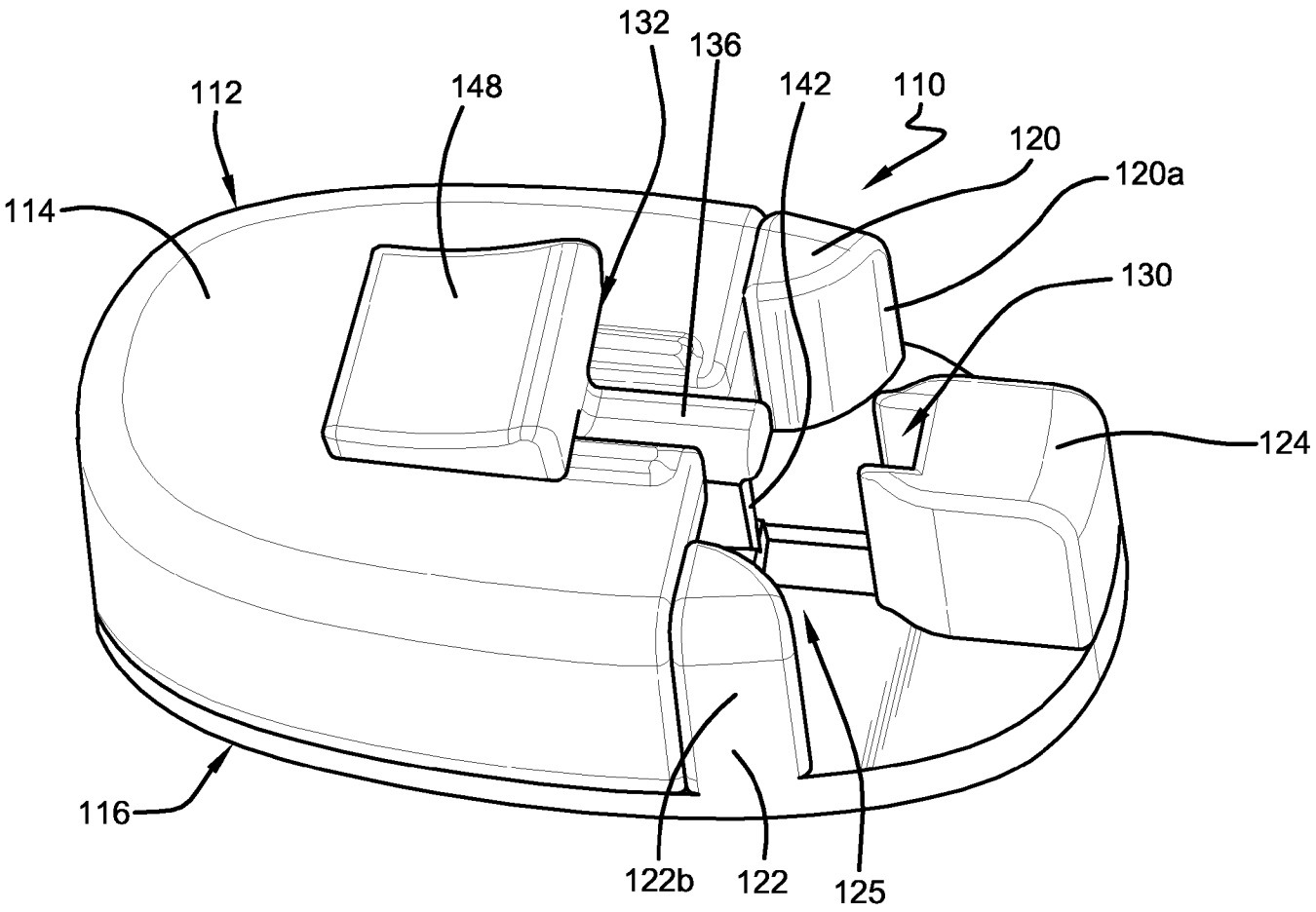
FIG. 6 is a perspective view of another embodiment of a line cutting device according to the concepts of the present disclosure.
Figure 7:
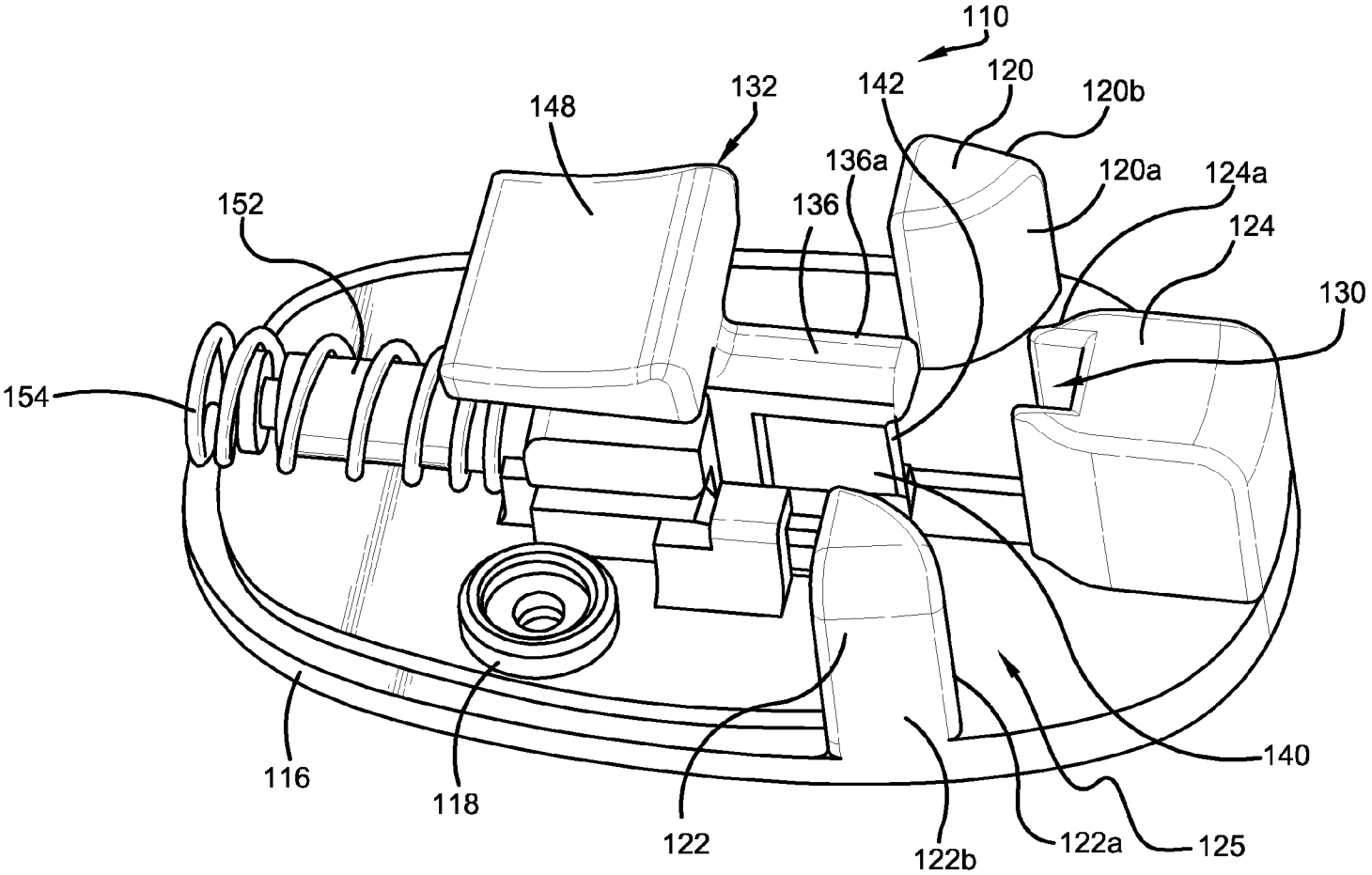
FIG. 7 is a top perspective view of the line cutting device of FIG. 6 with the cover portion removed to show the blade assembly.
Figure 8:
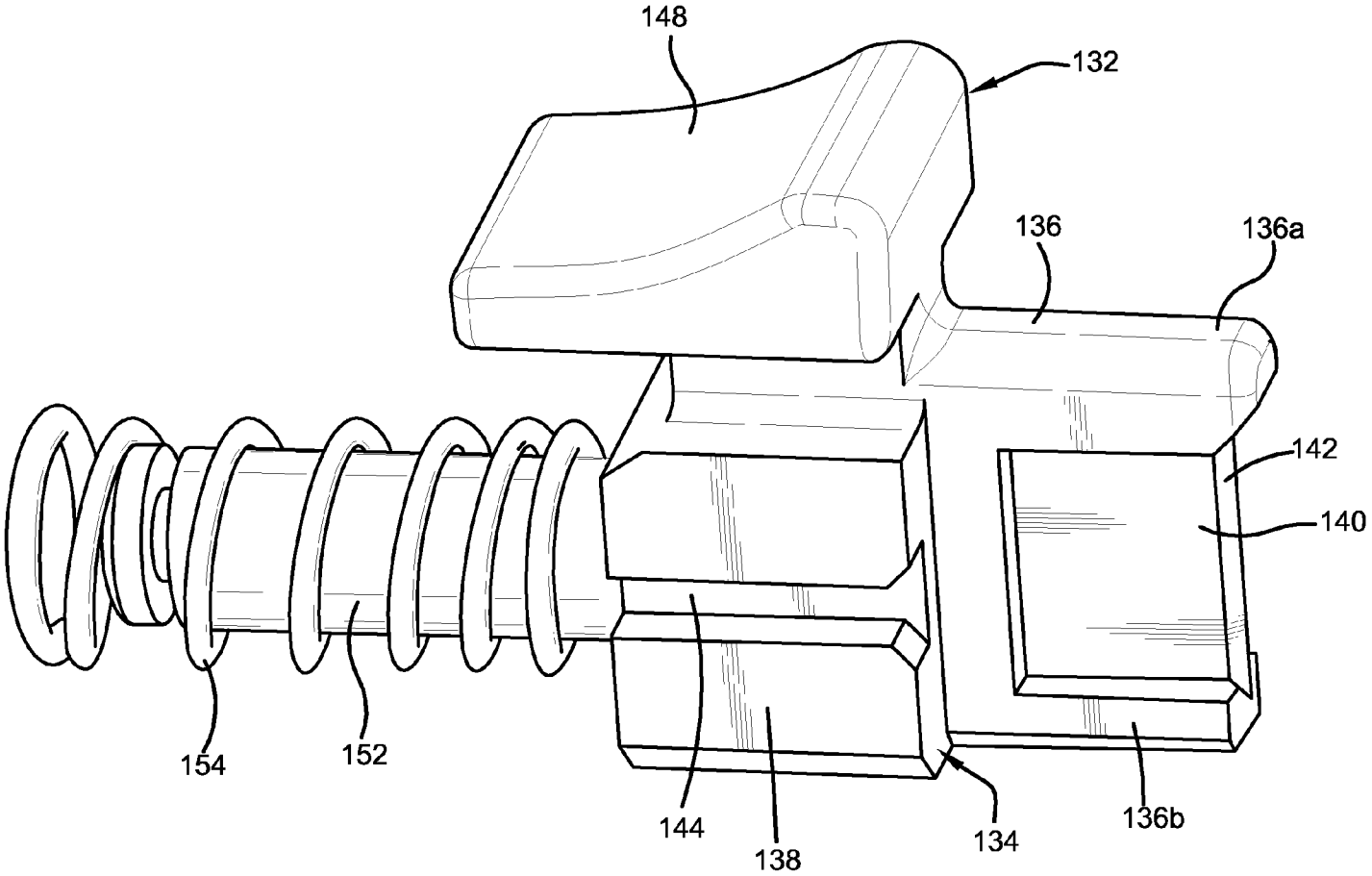
FIG. 8 is a perspective view of the blade assembly according to the concepts of the present invention.
Figure 9:
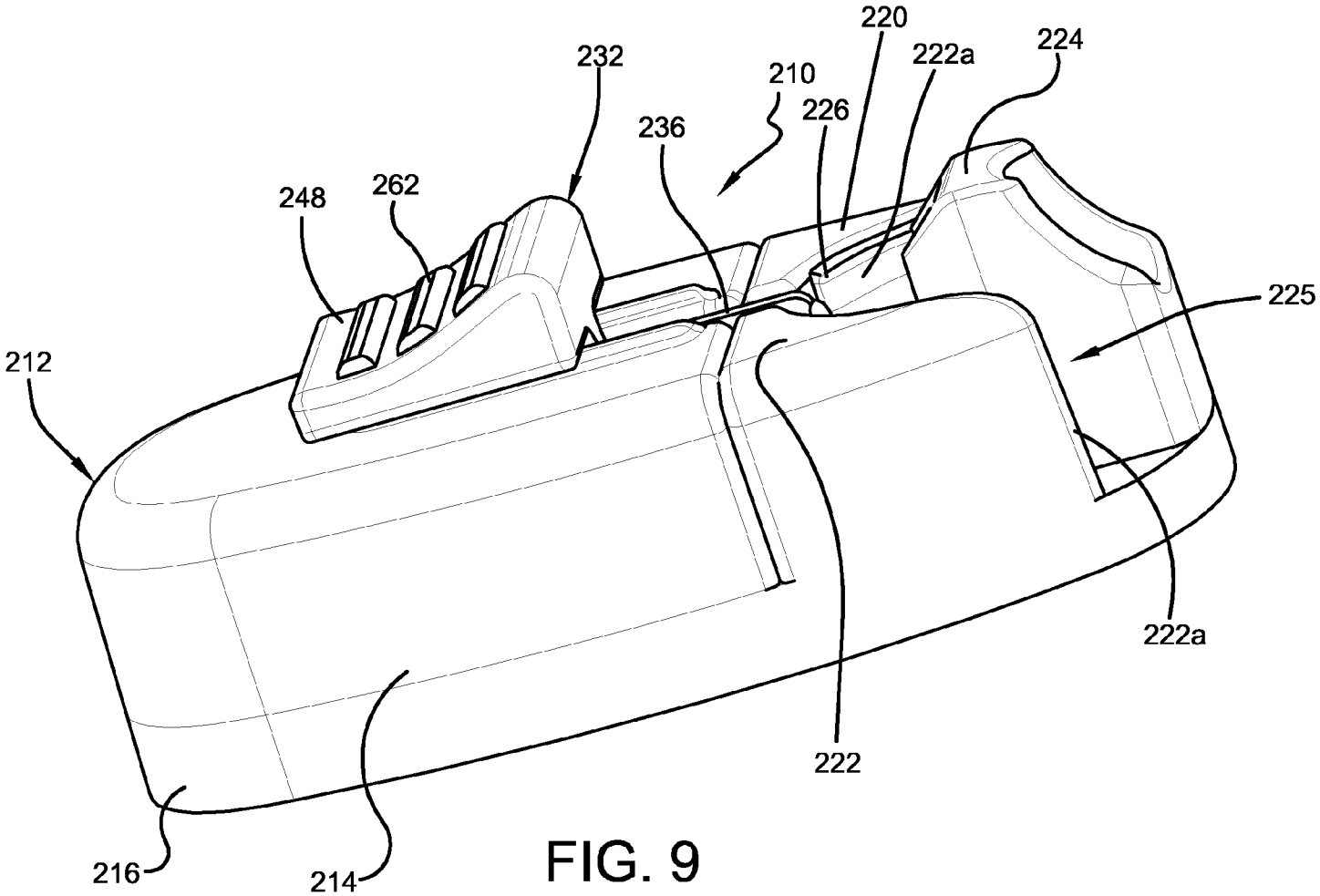
FIG. 9 is a side perspective view of another embodiment of a line cutting device according to the concepts of the present disclosure.
Figure 10:
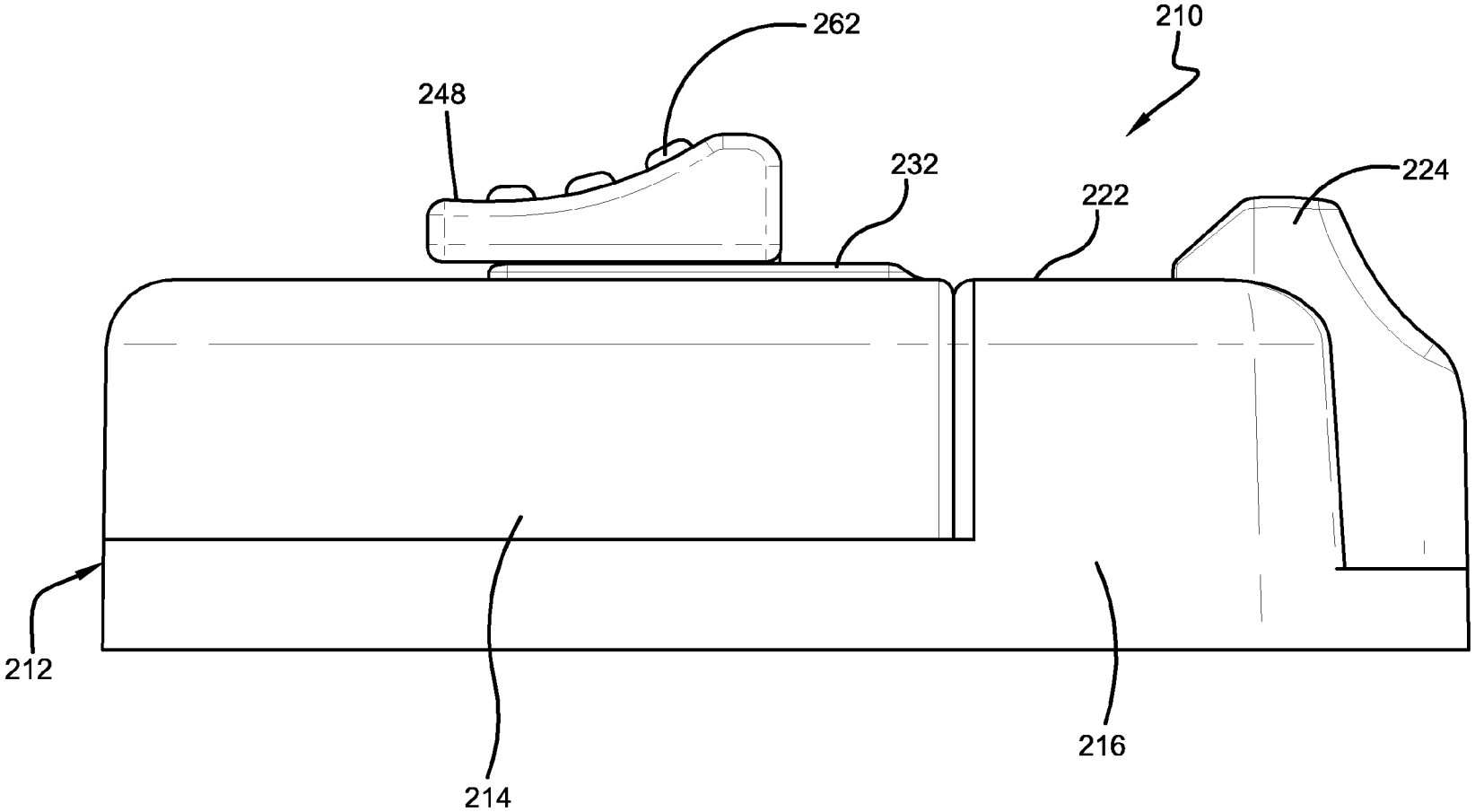
FIG. 10 is a side view of the line cutting device of FIG. 9.
Figure 11:
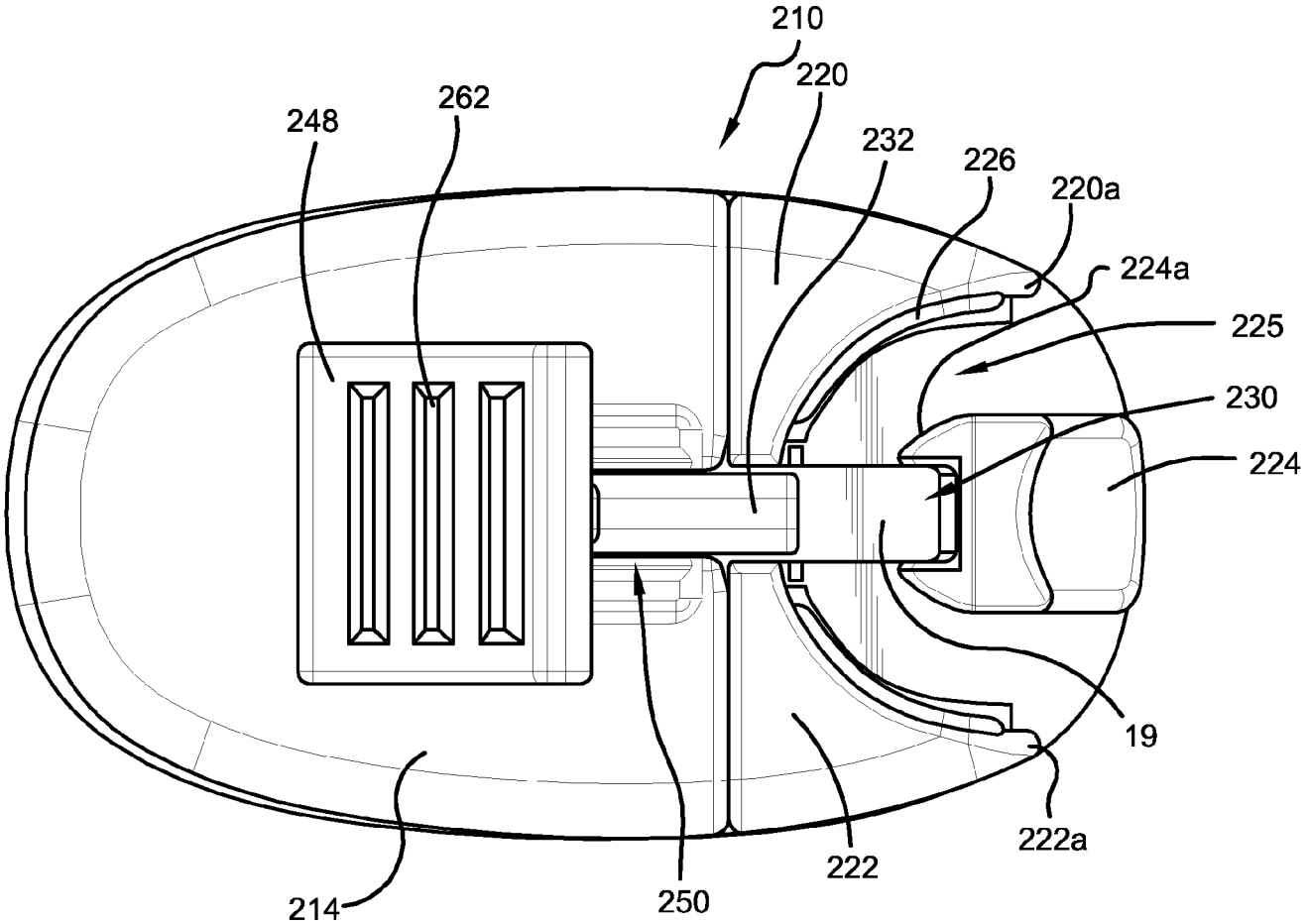
FIG. 11 is a top view of the line cutting device of FIG. 9.
Figure 12:
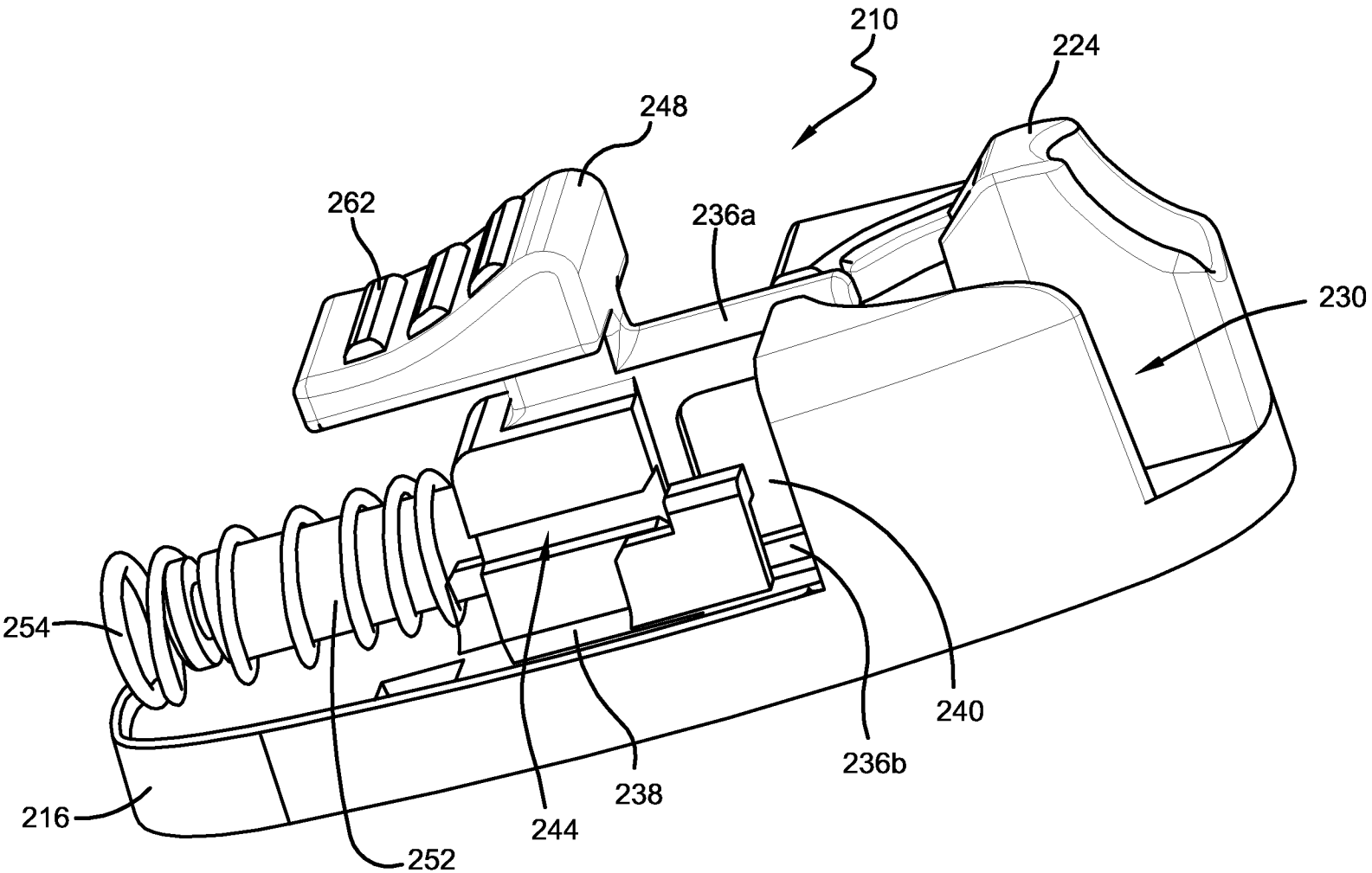
FIG. 12 is a perspective view of the line cutting device of FIG. 9 with the cover portion removed to show the blade assembly.
Figure 13:
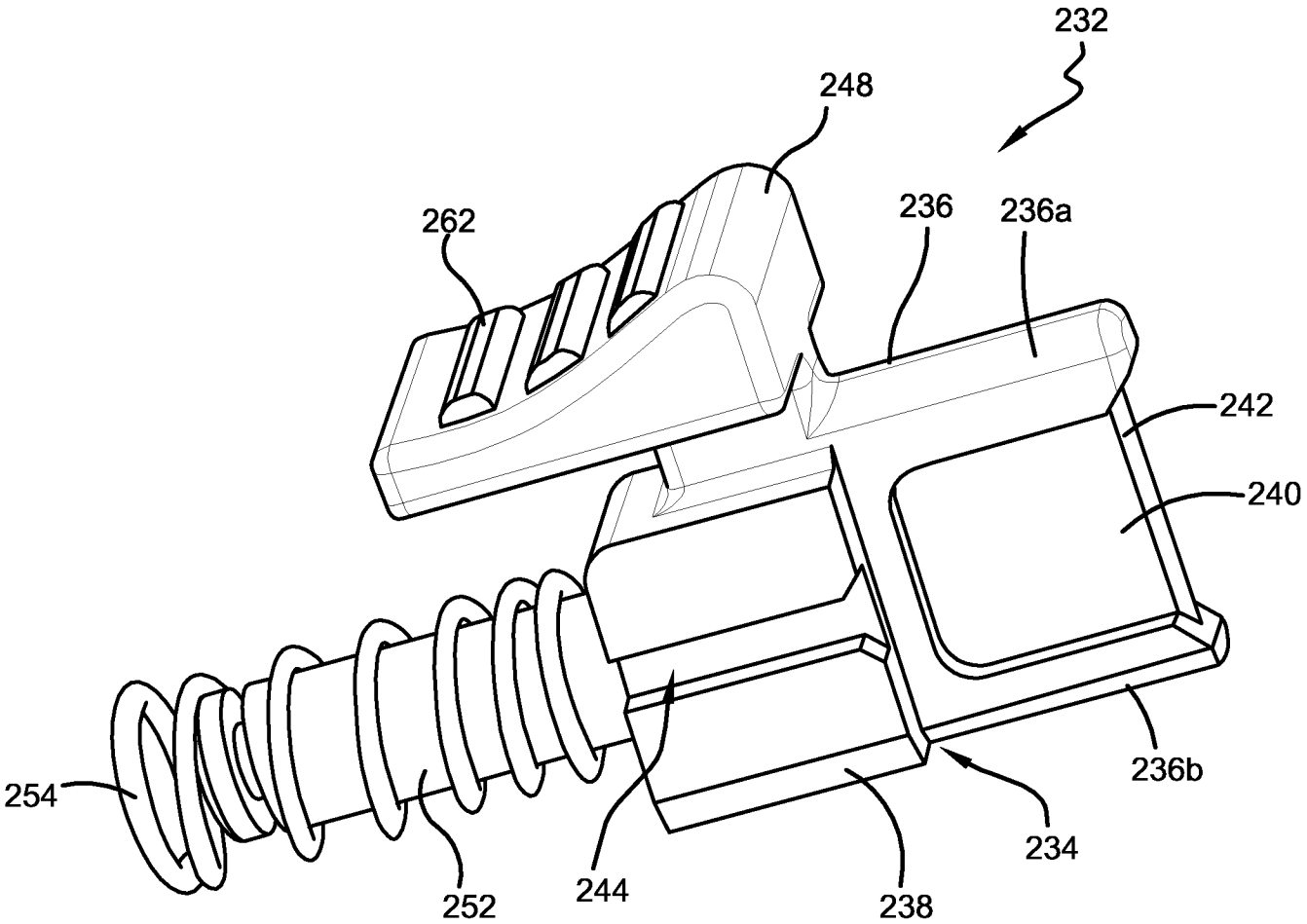
FIG. 13 is a perspective view of the blade assembly according to the concepts of the present disclosure.
Figure 14:
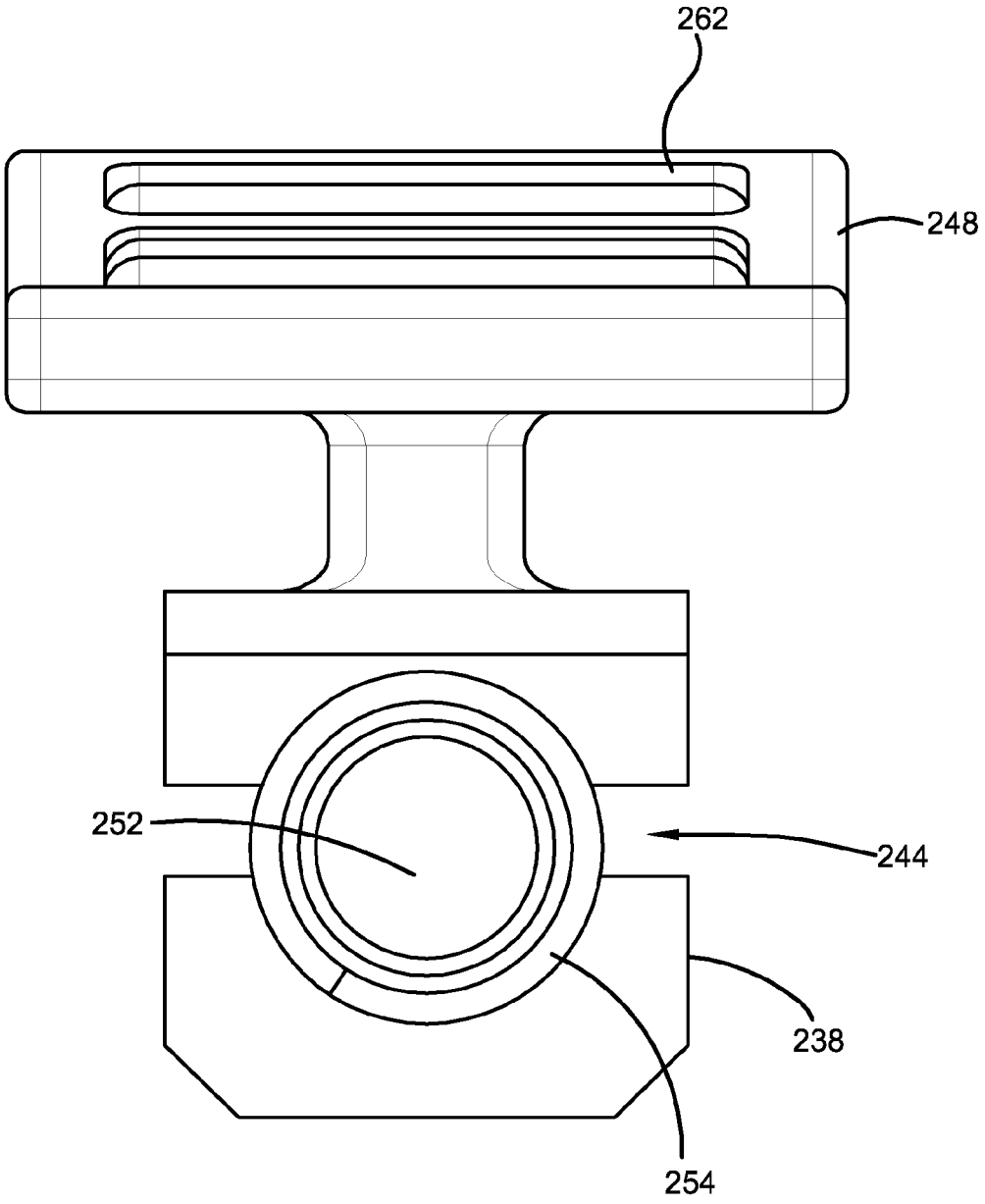
FIG. 14 is a rear end view of the blade assembly of FIG. 13.
Figure 15:
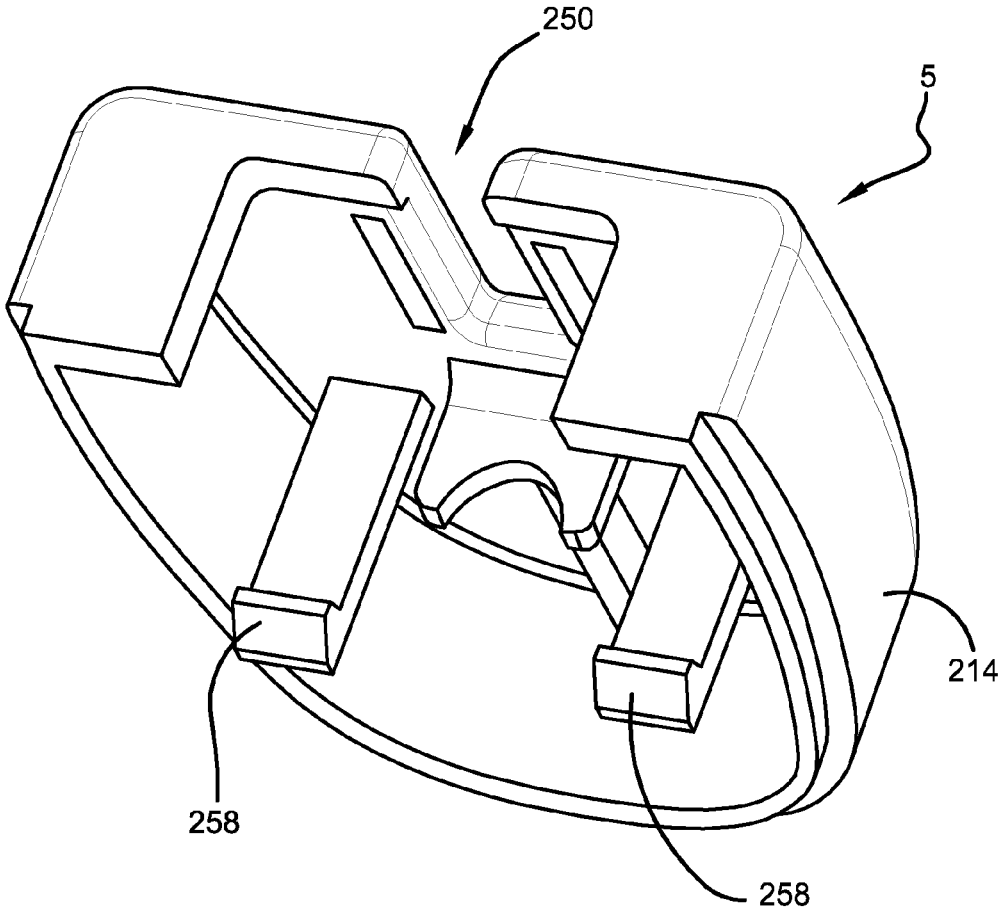
FIG. 15 is a perspective view of the cover portion of the line cutting device.
Figure 16:
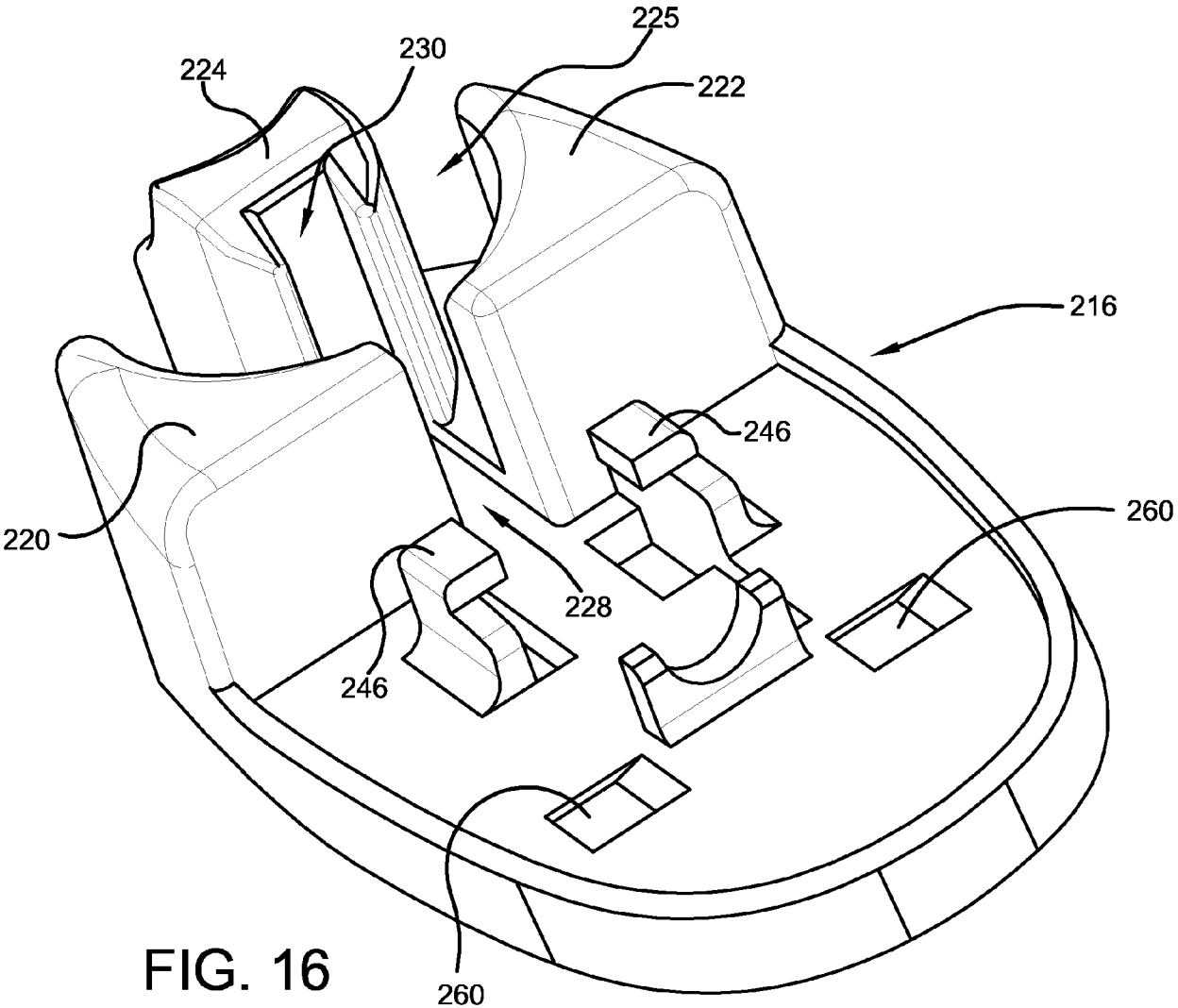
FIG. 16 is a top perspective view of the base portion of the line cutting device.
Figure 17:
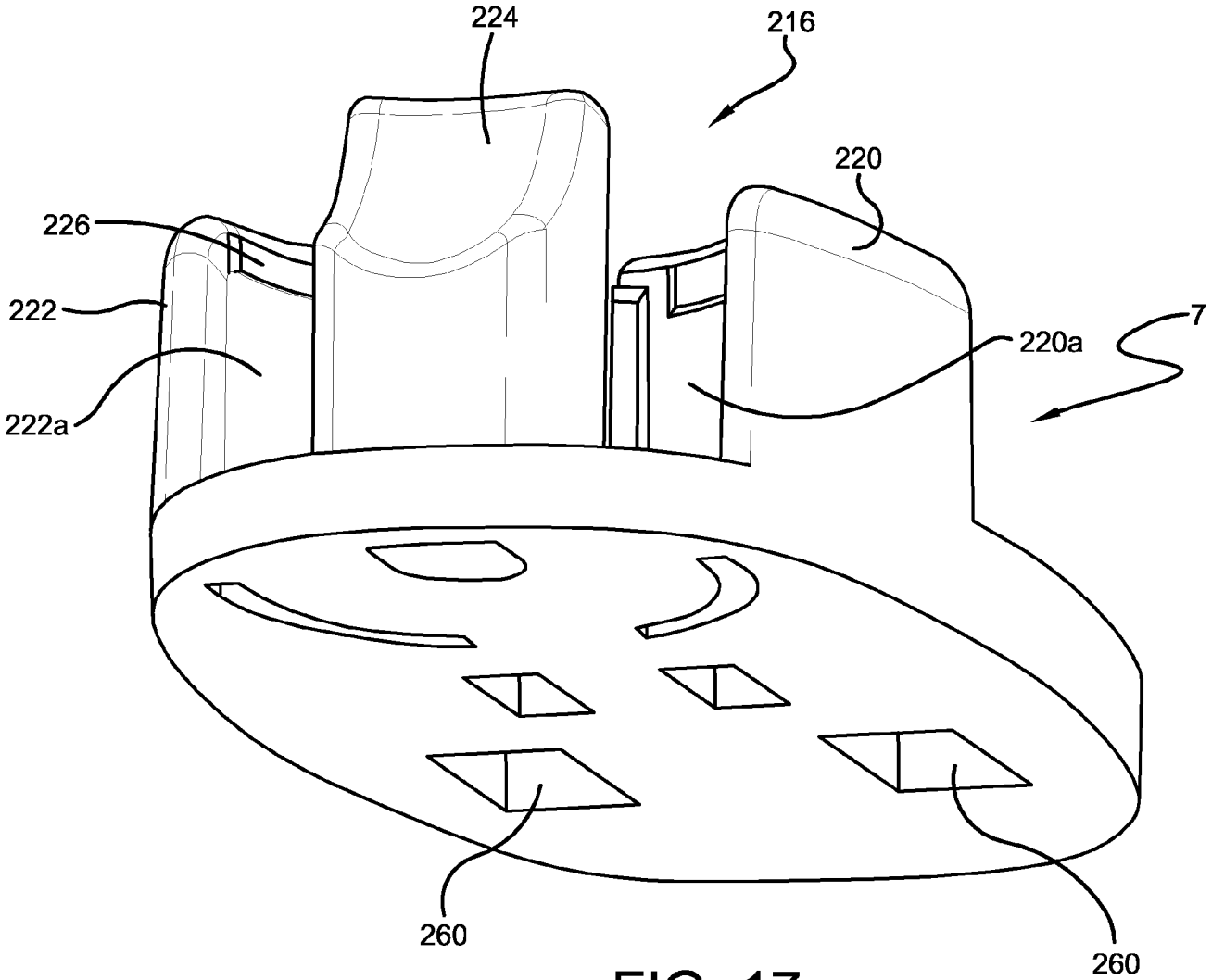
FIG. 17 is a bottom perspective view of the base portion.
Figure 18:
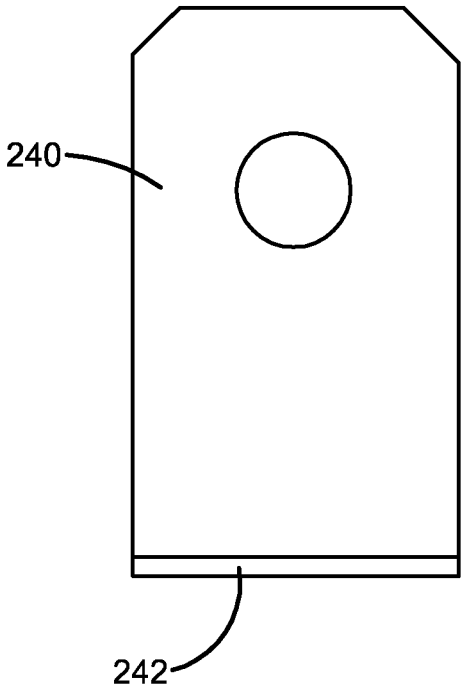
FIG. 18 is a top view of the cutting blade according to the concepts of the present disclosure.

Referring now to FIGS. 6-8, another embodiment of a cutting device according to the concepts of the present disclosure is shown and indicated generally by the numeral 110. Cutting device 110 is similar in many respects to cutting device 10, and like components are numbered accordingly (e.g. body 12 and body 112).

Cutting device 110 includes a spring 154 that is adapted to bias the blade assembly 132 away from the post 124. Thus, unlike cutting device 10, the blade assembly 132 is positioned in the retracted position absent a user initiated force applied to the button 148. This arrangement leaves the trough 125 unobstructed for positioning the monofilament line therein.

The first and second projections 120 and 122 of cutting device 110 are smaller in size than the first and second projections 20 and 22 of cutting device 10. The post 124 and the first and second projections 120 and 122 are orientated to cause only a slight bend or deformation of the trimmer line, with the line contacting the radiused surface 124*a* of the post 124 and the radiused surfaces 120*a* and 122*a* of the first and second projections 120 and 122. Thus, three contact points are created to create the necessary friction to retain the line in the body 112.

In use, the cutting device 110 operates similar to the cutting device 10 discussed above. However, since the blade assembly 132 is biased to the retracted position, the trimmer line may be positioned within the trough 125 without first moving the blade assembly 132. Once the trimmer line has been secured in the trough 125, a user applies a cutting force through the button 148, causing the cutting edge 142 of the blade 140 to engage and cut the line. In one or more embodiments, the line may be pulled back along outer surfaces 124*a* of the post 124 to create increased tension in the line prior to cutting. As in cutting device 10, the non-linear nature of the trough 125 creates tension and stress in the trimmer line and facilitates cutting of the line, while also securing the line in the body.

Referring now to FIGS. 9-18, another embodiment of a cutting device according to the concepts of the present disclosure is shown, and is generally indicated by the numeral 210. Cutting device 210 is substantially similar to cutting device 110 except as described below. Therefore, like components are numbered accordingly (e.g. body 112 and body 212).

Cutting device 210 includes a post 224 that is taller than the first and second projections 220 and 222. In certain embodiments, the top of the post 224 may be approximately vertically aligned with the top of the button 248. As with cutting device 110, the blade assembly 232 is biased in a retracted position and movement of button 248 toward post 224 causes cutting edge 242 of the cutting blade 240 to cut the line. With cutting device 210, a squeezing motion may be used to move button 248 toward post 224 due to the height of the post. This input mechanism for the cutting force generates minimal downward force on the cutting device 210, which may be important in embodiments where the device is positioned on or integral with a trimmer line package.

In one or more embodiments, a lip 226 may be provided on one or both of the first and second projections 220 and 222 or the post 224. The lip 226 extends inwardly into the trough 225 and is adapted to maintain the line within the trough as it is cut. In the same or other embodiments, the cover portion 214 may include one or more tabs 258 (best shown in FIG. 15) extending downwardly that are received in one or more openings 260 (best shown in FIG. 16) in the base portion 216. In one or more embodiments, the button 248 may include one or more ridges 262 on a top surface to facilitate gripping of the button by a user.

While several embodiments of cutting devices according to the concepts of the present disclosure have been disclosed, it will be apparent to those skilled in the art that various modifications are possible without deviating from the scope of the invention. For example, the shape and size of the trough (25, 125, 225) may be varied to suit the size of trimmer line to be cut. The cutting devices 10, 110, and 210 may be adapted to cut line having a diameter of between approximately 50 to 160 mil. Additionally, certain features of the various embodiments disclosed herein may be incorporated into the other embodiments, as desired.

In one or more embodiments, it is contemplated that the all or a portion of the first and second projections (20, 22, 120, 122, 220, 222) may be movable with the blade assembly (32, 132, 232), thereby further bending the line and generating increased stress in the outer surface of the line to facilitate cutting. Another feature contemplated is a releasable cocking mechanism for use in embodiments where the blade assembly is biased to the engaged position toward the post. The blade assembly 32 may be moved to the retracted position against the biasing force and retained in this cocked position by a releasable latch. After positioning the trimmer line in the trough 25, a trigger may be actuated to release the latch, allowing the blade assembly 32 to move toward the post 24 and cut the line.

In one or more embodiments, the cutting device 10, 110, 210 may include a hook or loop (not shown) attached to the body 12, 112, 212 to allow the device to be secured to a keychain. In the same or other embodiments, the body 12, 112, 212 may include a magnet embedded therein to allow it to be releasably attached to a metal surface. In certain embodiments, the cutting devices 10, 110, 210 may be sufficiently small to allow it to be easily transported. In one or more embodiments, the cutting device may have a width of less than 1.50 inches, a length of less than 2.50 inches, and/or a height of less than 0.75 inches.

It is thus evident that a cutting device constructed as described herein substantially improves the art. Only particular embodiment(s) have been presented and described in detail, and the invention should not be limited by the drawings or the description provided. For an appreciation of the true scope and breadth of the invention, reference should be made only to the following claims.

What is claimed is:

1. A cutting device comprising:

a body including a post having a radiused surface and a recess in the radiused surface, the body including two projections spaced from one another and the post and having radiused surfaces facing the post, the projections and the post defining a non-linear path for receipt of a line to be cut; and a reciprocating cutting blade assembly including a cutting blade with a cutting edge movable between a retracted position where the cutting edge is spaced from the recess and an engaged position where the cutting edge is positioned within the recess in the post and extends across the non-linear path, the cutting blade assembly adapted to cut a line wrapped around the post and extending over the recess as it moves linearly from the retracted position to the engaged position.

2. The cutting device of claim 1, where the cutting blade assembly includes a button for generating an input force from a user to move the cutting blade assembly.

3. The cutting device of claim 1, where the cutting blade assembly includes at least one slot, and the body includes at least one rail, the rail being received in the slot to slidably secure the cutting blade assembly to the body.

* * * * *